US011832371B2

(12) United States Patent
Teng et al.

(10) Patent No.: US 11,832,371 B2
(45) Date of Patent: Nov. 28, 2023

(54) OVER-VOLTAGE PROTECTION DEVICE

(71) Applicant: INPAQ TECHNOLOGY CO., LTD., Zhunan Township, Miaoli County (TW)

(72) Inventors: I-Jang Teng, Hsinchu (TW); Chun Peng Lin, Zhunan Township, Miaoli County (TW); Hsiu Lun Yeh, Pingzhen (TW)

(73) Assignee: INPAQ TECHNOLOGY CO., LTD., Zhunan Township (TW)

( * ) Notice: Subject to any disclaimer, the term of this patent is extended or adjusted under 35 U.S.C. 154(b) by 4 days.

(21) Appl. No.: 17/674,048

(22) Filed: Feb. 17, 2022

(65) Prior Publication Data

US 2023/0156897 A1 May 18, 2023

(30) Foreign Application Priority Data

Nov. 18, 2021 (TW) ..... 110143001

(51) Int. Cl.
*H05F 3/04* (2006.01)

(52) U.S. Cl.
CPC ..... *H05F 3/04* (2013.01)

(58) Field of Classification Search
CPC ..... H05F 3/04
USPC ..... 361/56
See application file for complete search history.

(56) References Cited

U.S. PATENT DOCUMENTS

2014/0029078 A1* 1/2014 Fennell ..... G02B 26/001 361/679.01
2014/0347772 A1* 11/2014 Yeh ..... H01L 27/0288 427/58
2015/0279602 A1* 10/2015 Molinero-Giles .... B81B 3/0008 200/181
2019/0366382 A1* 12/2019 Akiyama ..... B06B 1/0215
2022/0059640 A1* 2/2022 Park ..... H10K 71/00

* cited by examiner

*Primary Examiner* — Dharti H Patel
(74) *Attorney, Agent, or Firm* — Muncy, Geissler, Olds & Lowe

(57) ABSTRACT

The present disclosure provides an over-voltage protection device. The over-voltage protection device includes a substrate, a stack structure disposed over the substrate. The stack structure includes a first insulation structure, a second insulation structure, and a conductive layer. The conductive layer is disposed on the first insulation structure, and the second insulation structure is disposed on the conductive layer. The second insulation structure has an insulation air gap, which has an upper width greater than a lower width.

20 Claims, 13 Drawing Sheets

OVER-VOLTAGE PROTECTION DEVICE

TECHNICAL FIELD

The present disclosure relates to an over-voltage protection device, and more particularly, to an over-voltage protection device using air discharge technology.

DISCUSSION OF THE BACKGROUND

During the operation of the electronic circuit, if an abnormal voltage or electrostatic discharge (ESD) occurs, the electronic devices on the electronic circuit may be damaged. For this reason, over-voltage protection devices are often installed in electronic circuits to protect the electronic devices on the electronic circuit from being affected by abnormal voltage or electrostatic discharge.

With the advancement of current electronic products and the improvement of process technology, the size of electronic products is gradually shrinking. As a result, the damage caused by electrostatic discharge to precision electronic elements is becoming more and more serious. In addition, in recent years, the handheld mobile devices have been rapidly developed, so the demands for electrostatic protection are increasing. Among the current methods applied to electrostatic protection, air discharge is the most common method.

This Discussion of the Background section is provided for background information only. The statements in this Discussion of the Background are not an admission that the subject matter disclosed in this section constitutes prior art to the present disclosure, and no part of this Discussion of the Background section may be used as an admission that any part of this application, including this Discussion of the Background section, constitutes prior art to the present disclosure.

SUMMARY

One embodiment of the present disclosure provides an over-voltage protection device. The over-voltage protection device includes a substrate; and a stack structure, disposed over the substrate. The stack structure includes a first insulation structure, a second insulation structure, and a conductive layer. The conductive layer is disposed on the first insulation structure, and the second insulation structure is disposed on the conductive layer. The second insulation structure has an insulation air gap, which has an upper width greater than a lower width.

In some embodiments, the second insulation structure has a thickness greater than that of the first insulation structure.

In some embodiments, the first insulation structure has a lower air gap, which is connected with the insulation air gap.

In some embodiments, the first insulation structure has a lower air gap, which has a width smaller than the lower width of the insulation air gap.

In some embodiments, the conductive layer has a conductive layer air gap, which has a width smaller than the lower width of the insulation air gap.

In some embodiments, the first insulation structure has a lower air gap, the conductive layer has a conductive layer air gap, and the lower air gap has a width greater than that of the conductive layer air gap.

In some embodiments, the second insulation structure includes a lower portion; an upper portion, disposed over the lower portion; and a top cover portion, disposed over the upper portion.

In some embodiments, the second insulation structure includes a lower portion, having a lower opening; an upper portion, disposed over the lower portion, the upper portion has an upper opening; and a top cover portion, disposed over the upper portion; wherein the lower opening is connected with the upper opening, and an upper end of the insulation air gap is sealed by the top cover portion.

In some embodiments, the second insulation structure includes a lower portion, having a lower opening; an upper portion, disposed over the lower portion, the upper portion has an upper opening; a top cover portion, disposed over the upper portion; a first conductive material portion, disposed within the lower opening; and a second conductive material portion; disposed on a lower surface of the top cover portion; wherein the first conductive material portion and the second conductive material portion are separated from each other.

In some embodiments, the second insulation structure includes a lower portion, having a lower opening; an upper portion, disposed over the lower portion, the upper portion has an upper opening; a top cover portion, disposed over the upper portion; a first conductive material portion, disposed within the lower opening; and a second conductive material portion, disposed on a lower surface of the top cover portion; wherein the second conductive material portion has a thickness smaller than that of the upper portion.

Another embodiment of the present disclosure provides an over-voltage protection device, including a substrate; a conductive layer, disposed on the substrate; and an insulation structure, disposed on the conductive layer; wherein the insulation structure has an insulation air gap, which has an upper width greater than a lower width.

In some embodiments, the substrate has a recessed slot, and the insulation air gap has a height greater than that of the recessed slot.

In some embodiments, the substrate has a recessed slot, which is connected with the insulation air gap.

In some embodiments, the substrate has a recessed slot, which has a width smaller than the lower width of the insulation air gap.

In some embodiments, the conductive layer has a conductive layer air gap, which has a width smaller than the lower width of the insulation air gap.

In some embodiments, the substrate has a recessed slot, the conductive layer has a conductive layer air gap, and the recessed slot has a width smaller than that of the conductive layer air gap.

In some embodiments, the insulation structure includes a lower portion; an upper portion, disposed over the lower portion; and a top cover portion, disposed over the upper portion.

In some embodiments, the insulation structure includes a lower portion, having a lower opening; an upper portion, disposed over the lower portion, the upper portion has an upper opening; and a top cover portion, disposed over the upper portion; wherein the lower opening is connected with the upper opening, and an upper end of the insulation air gap is sealed by the top cover portion.

In some embodiments, the insulation structure includes a lower portion, having a lower opening; an upper portion, disposed over the lower portion, the upper portion has an upper opening; a top cover portion, disposed over the upper portion; a first conductive material portion, disposed within the lower opening; and a second conductive material portion, disposed on a lower surface of the top cover portion; wherein the first conductive material portion and the second conductive material portion are separated from each other.

In some embodiments, the insulation structure includes a lower portion, having a lower opening; an upper portion, disposed over the lower portion, the upper portion has an upper opening; a top cover portion, disposed over the upper portion; a first conductive material portion, disposed within the lower opening; and a second conductive material portion, disposed on a lower surface of the top cover portion; wherein the first conductive material portion has a thickness smaller than that of the lower portion, and the second conductive material portion has a thickness smaller than that of the upper portion.

The foregoing has outlined rather broadly the features and technical advantages of the present disclosure in order that the detailed description of the disclosure that follows may be better understood. Additional features and advantages of the disclosure will be described hereinafter, and form the subject of the claims of the disclosure. It should be appreciated by those skilled in the art that the conception and specific embodiment disclosed may be readily utilized as a basis for modifying or designing other structures or processes for carrying out the same purposes of the present disclosure. It should also be realized by those skilled in the art that such equivalent constructions do not depart from the spirit and scope of the disclosure as set forth in the appended claims.

BRIEF DESCRIPTION OF THE DRAWINGS

Aspects of the present disclosure are best understood from the following detailed description when read with the accompanying figures. It should be noted that, in accordance with the standard practice in the industry, various features are not drawn to scale. In fact, the dimensions of the various features may be arbitrarily increased or reduced for clarity of discussion.

DETAILED DESCRIPTION

The following description of the present disclosure is accompanied by the figures that are incorporated into and constitute a part of the specification to illustrate the embodiments of the present disclosure, but the present disclosure is not limited to the embodiments. In addition, the following embodiments can be appropriately integrated to complete another embodiment.

"One embodiment", "embodiment", "exemplary embodiment", "other embodiments", "another embodiment", etc. refer to that the embodiments described in this disclosure may include specific features, structures, or characteristics. However, not every embodiment has to include the specific features, structures, or characteristics. Furthermore, the repeated term "in an embodiment" does not necessarily refer to the same embodiment, but may be the same embodiment.

In order to make the present disclosure fully understandable, the following description provides detailed steps and structures. Obviously, the specific details known to those skilled in the art would not be limited by the implementation of the present disclosure. In addition, the known structures and steps will not be described in detail, so as not to unnecessarily limit the present disclosure. The preferred embodiments of the present disclosure are described in detail as follows. However, in addition to detailed descriptions, the present disclosure can also be widely implemented in other embodiments. The scope of this disclosure is not limited to the content of the detailed description, but is defined by the appended claims.

Figure 1:
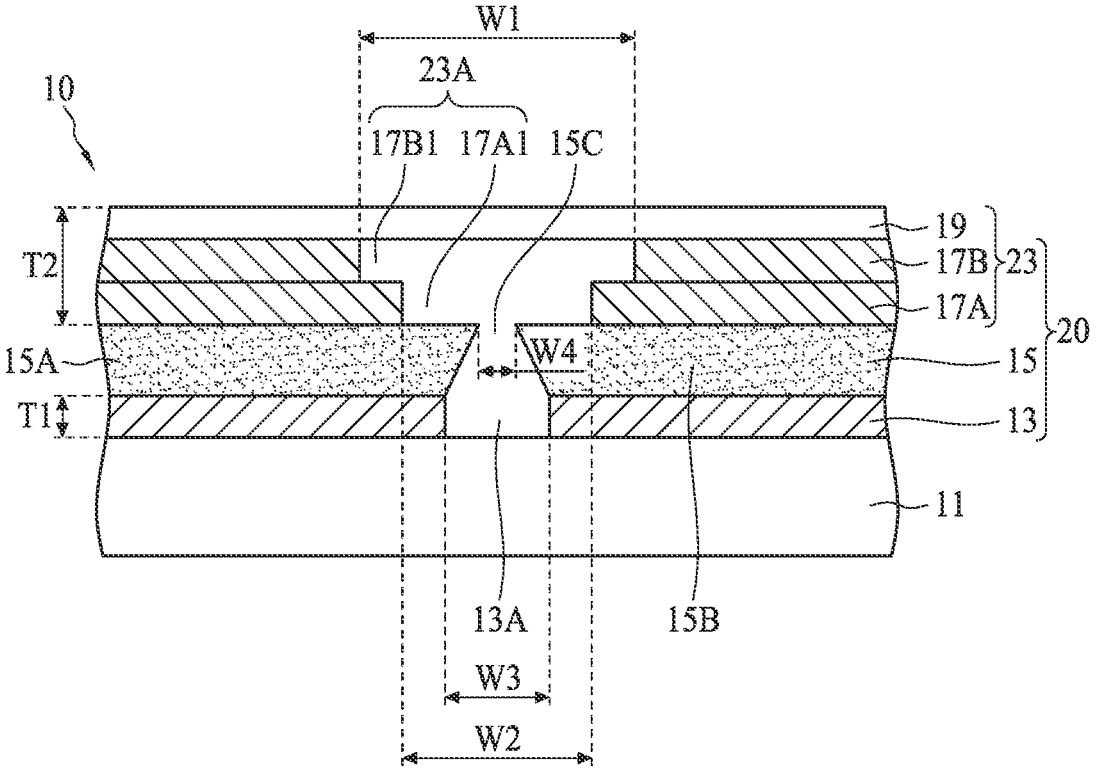
FIG. 1 illustrates an over-voltage protection device according to an embodiment of the present disclosure.

FIG. 1 illustrates an over-voltage protection device 10 according to an embodiment of the present disclosure. In one embodiment, the over-voltage protection device 10 includes a substrate 11 and a stack structure 20. The stacked structure 20 is disposed on the substrate 11 and includes a first insulation structure 13, a second insulation structure 23, and a conductive layer 15. The conductive layer 15 is disposed on the first insulation structure 13, and the second insulation structure 23 is disposed on the conductive layer 15. In one embodiment, the second insulation structure 23 has an insulation air gap 23A, in which the upper width W1 is greater than the lower width W2. In one embodiment, the insulation air gap 23A has a trapezoidal profile. In one embodiment, the thickness T2 of the second insulation structure 23 is greater than the thickness T1 of the first insulation structure 13.

In one embodiment, the first insulation structure 13 has a lower air gap 13A, which is connected with the insulation air gap 23A. The width W3 of the lower air gap 13A is smaller than the lower width W2 of the insulation air gap 23A. In one embodiment, the conductive layer 15 has a first electrode 15A and a second electrode 15B, both of which form a discharge path. The conductive layer 15 has a conductive layer air gap 15C between the first electrode 15A and the second electrode 15B. The width W4 of the conductive layer air gap 15C is smaller than the lower width W2 of the insulation air gap 23A. In one embodiment, the width W3 of the lower air gap 13A is greater than the width W4 of the conductive layer air gap 15C. In one embodiment, the width W4 of the conductive layer air gap 15C is greater than or equal to the lower width W2 of the insulation air gap 23A.

In one embodiment, the second insulation structure 23 includes a lower portion 17A, an upper portion 17B, and a top cover portion 19. The upper portion 17B is disposed over the lower portion 17A, and the top cover portion 19 is disposed over the upper portion 17B. In one embodiment, the lower portion 17A has a lower opening 17A1, the upper portion 17B has an upper opening 17B1, and the lower opening 17A in connected with the upper opening 17B to form the insulation air gap 23A. The upper end of the insulation air gap 23A is sealed by the top cover portion 19.

In one embodiment, the substrate 11 includes alumina or ceramic material, the first insulation structure 13 includes polyimide, the conductive layer 15 includes copper, the lower portion 17A and the upper portion 17B include epoxy resin or polyimide, and the top cover portion 19 includes epoxy resin or polyimide. In one embodiment, in order to prevent substances from the external environment from falling between the first electrode 15A and the second electrode 15B, causing the first electrode 15A and the second electrode 15B to form a short circuit, the top cover portion 19 of the over-voltage protection device 10 is configured to isolate the conductive layer 15 from the external environment. In one embodiment, the lower portion 17A and the upper portion 17B isolate the top cover portion 19 and the conductive layer 15, the insulation air gap 23A and the lower air gap 13A also provide additional space, so that the first tip and the second tip can discharge through air therebetween.

Figure 2:
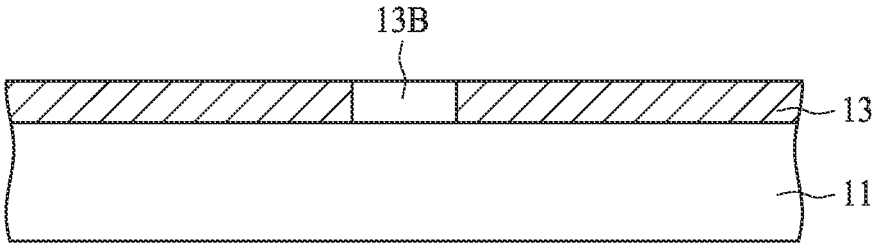
FIG. 2 to FIG. 13 illustrate a method for manufacturing the over-voltage protection device according to an embodiment of the present disclosure.
Figure 3:
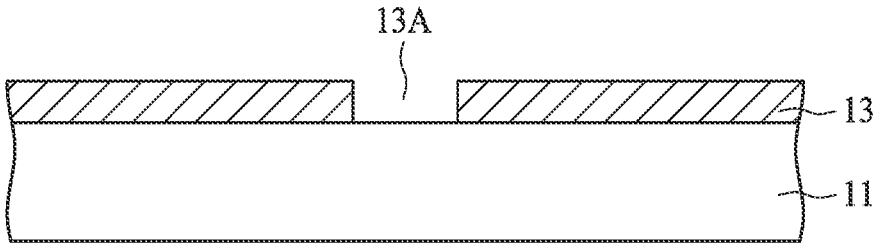

FIGS. 2 to 13 illustrates a method for manufacturing the over-voltage protection device 10 according to an embodiment of the present disclosure. With reference to FIG. 2, in one embodiment, a first insulation structure 13 (for example, a photosensitive polyimide layer) is first formed on a substrate 11 (for example, an alumina substrate or a ceramic substrate), and a predetermined area 13B of the insulation structure 13 is subjected to an exposure process. Then, a developing process is performed to partially remove the predetermined area 13B to form a lower air gap 13A in the first insulation structure 13, as shown in FIG. 3.

Figure 4:
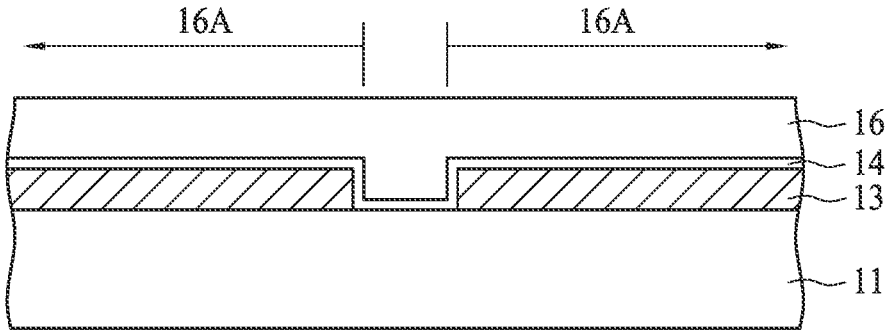
Figure 5:
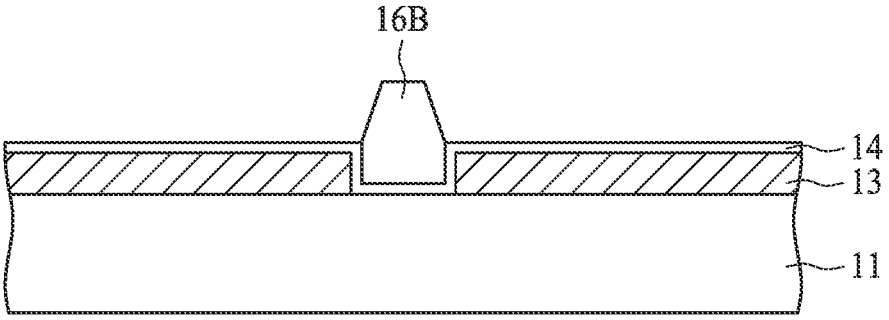

With reference to FIG. 4, a sputtering process is performed to form a seed layer 14 (for example, a titanium-tungsten alloy layer, a copper layer, a nickel-chromium alloy layer) on the first insulation structure 13 and the substrate 11, and a coating process is performed to form a photoresist layer 16 over the seed layer 14. An exposure process is then performed on a predetermined area 16A of the photoresist layer 16. Afterwards, a developing process is performed to partially remove the predetermined area 16A to form a photoresist pattern 16B, which fills the lower air gap 13A and protrudes from the first insulation structure 13, as shown in FIG. 5. In one embodiment, the photoresist pattern 16B has a cross section with a narrow top and a wide bottom.

Figure 6:
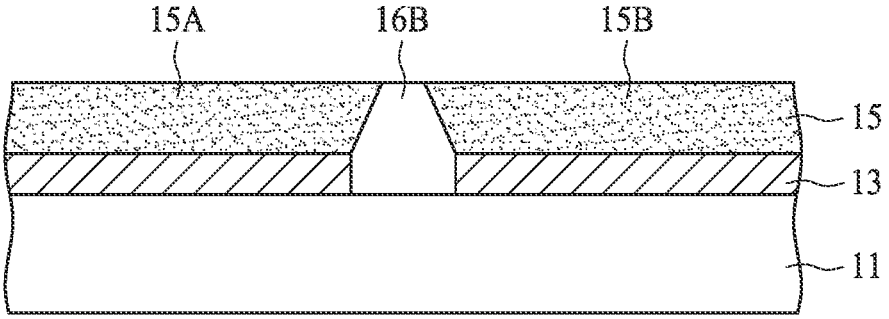
Figure 7:
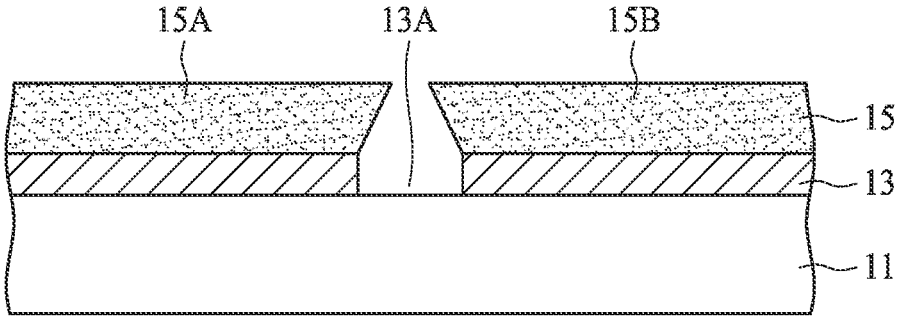

With reference to FIG. 6, an electroplating process is performed to form a conductive layer 15 on the first insulation structure 13. The photoresist pattern 16B separates the conductive layer 15 to form a first electrode 15A and a second electrode 15B. Afterwards, the photoresist pattern 16B is removed, so the first electrode 15A and the second electrode 15B form a discharge path and the lower air gap 13A is located below the discharge path, as shown in FIG. 7. In FIG. 6 and FIG. 7, the seed layer 14 has been incorporated into the conductive layer 15 and is not shown in the figures. In one embodiment, since the photoresist pattern 16B has a cross section with a narrow top and a wide bottom, the cross section of the first electrode 15A has a first tip, the cross section of the second electrode 15B has a second tip, and the first tip and the second tip are disposed over the lower air gap 13A.

Figure 8:
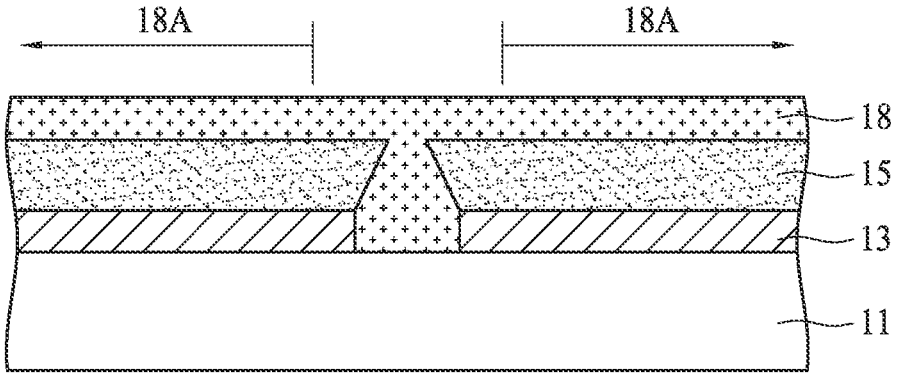
Figure 9:
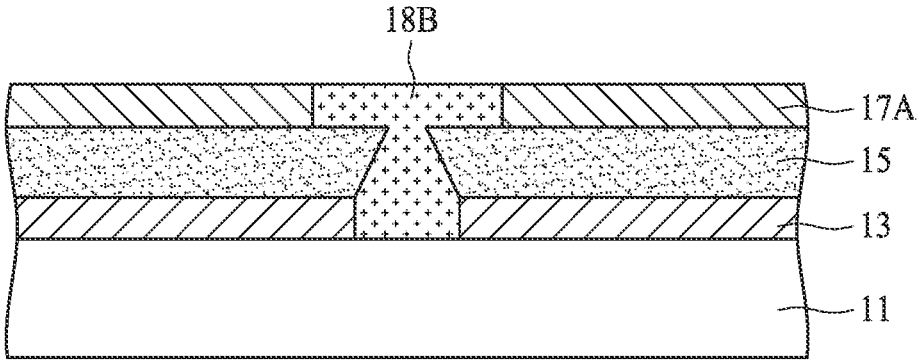

With reference to FIG. 8, a coating process is performed to form a photoresist layer 18 on the conductive layer 15, an exposure process is performed on a predetermined area 18A of the photoresist layer 18, and then a developing process is performed to partially remove the photoresist layer 18 in the predetermined area 18A to form a photoresist pattern 18B. Afterwards, the photoresist pattern 18B is used to form a lower portion 17A over the conductive layer 15, as shown in FIG. 9.

Figure 10:
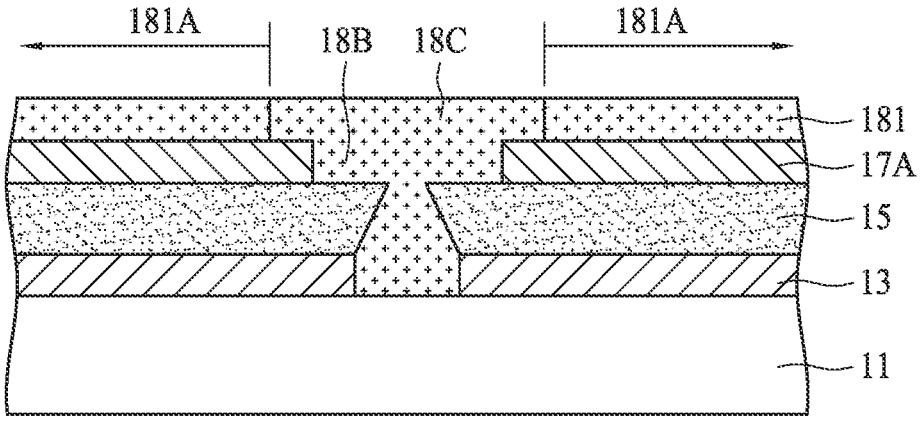
Figure 11:
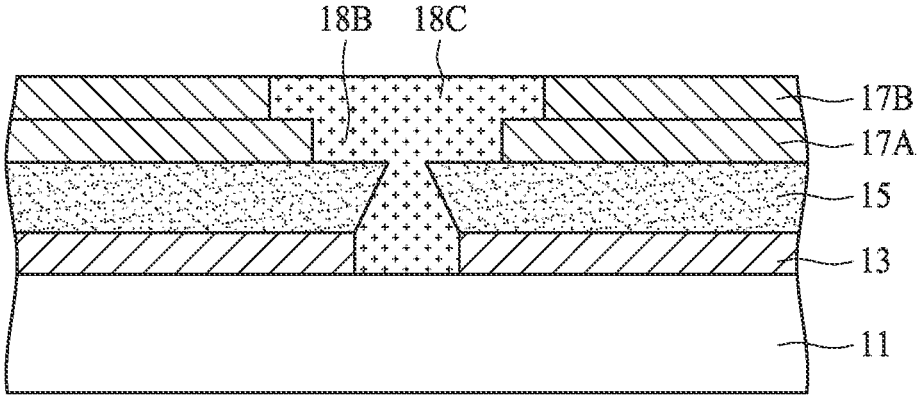

With reference to FIG. 10, a coating process is performed to form a photoresist layer 181 on the conductive layer 15 and the lower portion 17A. An exposure process is performed on a predetermined area 181A of the photoresist layer 181, and then a developing process is performed to partially remove the photoresist layer 181 in the predetermined area 181A to form a photoresist pattern 18C. The width of the photoresist pattern 18C is greater than the width of the photoresist pattern 18B. Afterwards, the photoresist pattern 18C is used to form an upper portion 17B over the lower portion 17A, as shown in FIG. 11.

Figure 12:
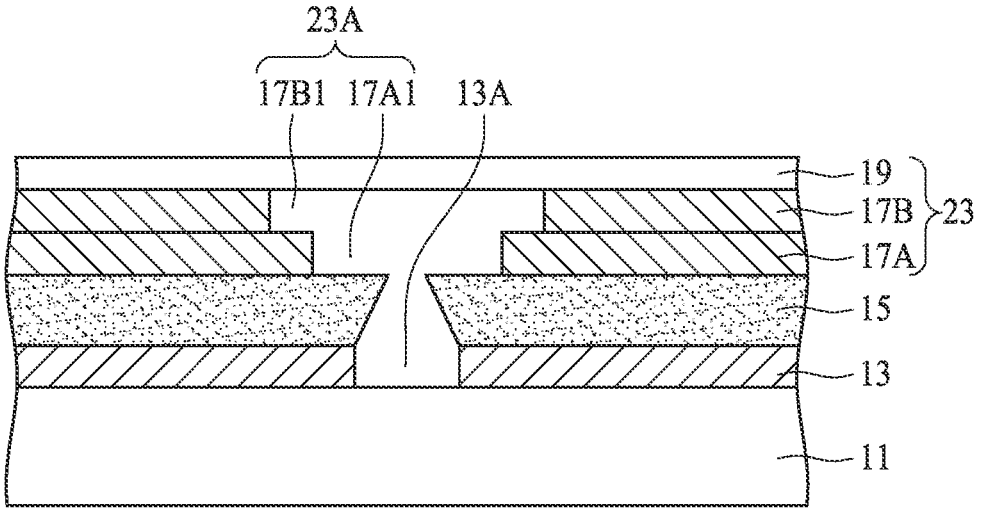

With reference to FIG. 12, the photoresist pattern 18B and the photoresist pattern 18C are removed to form a lower opening 17A1 within the lower portion 17A and an upper opening 17B1 within the upper portion 17B. The lower opening 17A1 and the upper opening 17B1 form an insulation air gap 23A, which at least partially expose the first electrode 15A and the second electrode 15B. The cross-sectional width of the insulation air gap 23A is larger than the cross-sectional width of the lower air gap 13A of the first insulation structure 13. Afterwards, a top cover portion 19 (for example, a polyimide dry film) is pasted on the upper portion 17B and seals the insulation air gap 23A.

Figure 13:
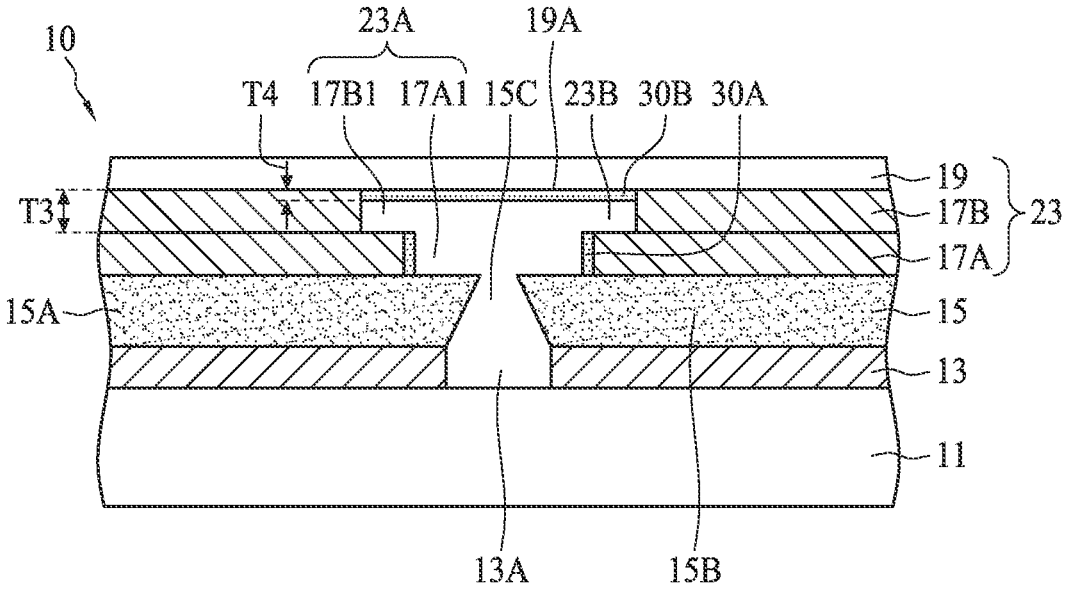

With reference to FIG. 13, in one embodiment, when a high voltage is applied to the first electrode 15A and the second electrode 15B, the first tip and the second tip discharge through the air therebetween, which acts like an arc discharge, causing the first electrode 15A and the second electrode 15B to generate electrode debris. The lower air gap 13A can accommodate the metal debris falling during the discharge, and avoid the accumulation of metal debris which causes the first electrode 15A and the second electrode 15B to form a short circuit.

In addition, the high temperature of the instantaneous point discharge of the first tip of the first electrode 15A and the second tip of the second electrode 15B will also cause the molten metal debris to spray upwards and adhere to the second insulation structure 23, forming a first conductive material portion 30A within the lower opening 17A1 or forming a second conductive material portion 30B on the lower surface 19A of the top cover portion 19. The innovative technique of the present disclosure is designed to have a width of the upper opening 17B1 greater than that of the lower opening 17A1. That is, the upper opening 17B1 of the second insulation structure 23 is provided with a dead corner 23B. As a result, the first conductive material portion 30A and the second conductive material portion 30B formed by the molten metal debris sprayed upwards are separated by the dead corner 23A of the upper opening 17B1 of the second insulation structure 23, and cannot form a continuous conductive path, so as to prevent the first electrode 15A and the second electrode 15B from forming a short circuit. In one embodiment, the thickness T4 of the second conductive material portion 30B is smaller than the thickness T3 of the upper portion 17B, so as to prevent the first conductive material portion 30A and the second conductive material portion 30B from forming a short circuit.

Figure 14:
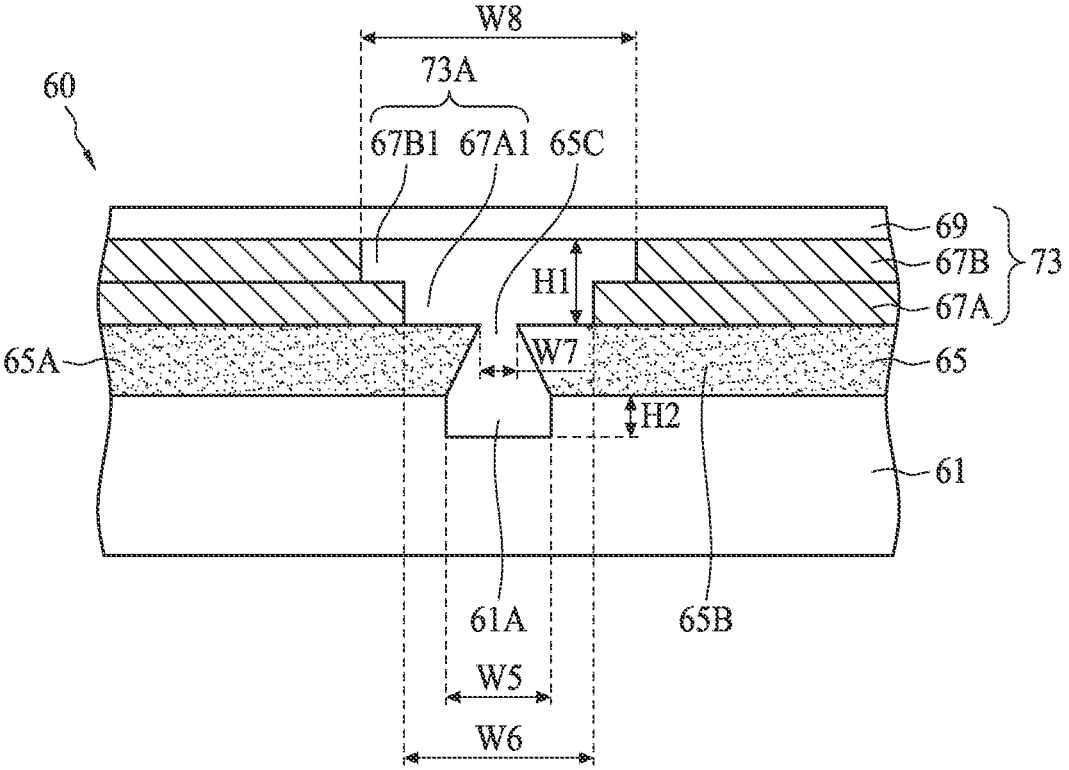
FIG. 14 illustrates an over-voltage protection device according to another embodiment of the present disclosure.

FIG. 14 illustrates an over-voltage protection device 60 according to another embodiment of the present disclosure. In one embodiment, the over-voltage protection device 60 includes an insulation substrate 61, a conductive layer 65, an insulation structure 73, and a top cover portion 69. In this embodiment, the insulation substrate 61 has a recessed slot 61A. The conductive layer 65 is disposed over the insulation substrate 61 and has a first electrode 65A and a second electrode 65B, both of which form a discharge path, and the recessed slot 61A is located below the discharge path. The insulation structure 73 is disposed over the conductive layer 65 and has an insulation air gap 73A which at least partially exposes the first electrode 65A and the second electrode 65B.

In one embodiment, the upper width W8 of the insulation air gap 73A is greater than the lower width W6. In one embodiment, the insulation air gap 73A has a trapezoidal profile. In one embodiment, the height H1 of the insulation air gap 73A is greater than the height H2 of the recessed slot 61A, the width W5 of the recessed slot 61A is smaller than the lower width W6 of the insulation air gap 73A, and the recessed slot 61A is connected with the insulation air gap 73A. In one embodiment, the conductive layer 65 has a conductive layer air gap 65C. The width W7 of the conductive layer air gap 65C is smaller than the lower width W6 of the insulation air gap 73A, and the width W5 of the recessed slot 61A is greater than the width W7 of the conductive layer air gap 65C. In one embodiment, the width W7 of the conductive layer air gap 65C is greater than or equal to the lower width W6 of the insulation air gap 73A.

In one embodiment, the insulation structure 73 includes a lower portion 67A, an upper portion 67B, and a top cover portion 69. The upper portion 67B is disposed over the lower portion 67A, and the top cover portion 69 is disposed over the upper portion 67B. In one embodiment, the lower portion 67A has a lower opening 67A1, the upper portion 67B has an upper opening 67B1, the lower opening 67A1 is connected with the upper opening 67B1 to form an insulation air gap 73A. The upper end of the insulation air gap 73A is sealed by the top cover portion 69. In one embodiment, the insulation substrate 61 includes alumina or ceramic material, the conductive layer 65 includes copper, and the insulation structure 73 includes epoxy or polyimide.

Figure 15:
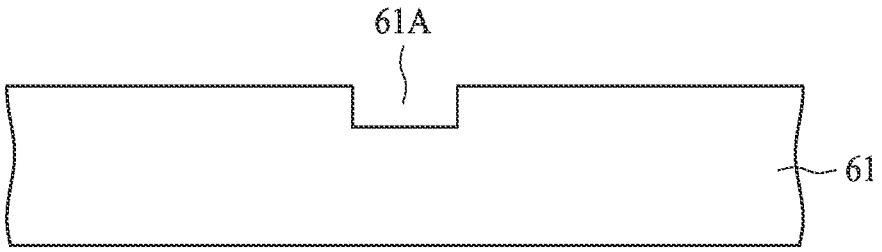
FIG. 15 to FIG. 25 illustrate a method for manufacturing the over-voltage protection device according to another embodiment of the present disclosure.

FIGS. 15 to 25 illustrate a method for manufacturing an over-voltage protection device 60 according to another embodiment of the present disclosure. With reference to FIG. 15, in one embodiment, first, a recessed slot 61A is formed on the upper surface of an insulation substrate 61 (for example, an alumina substrate or a ceramic substrate). An infrared laser or ultraviolet laser may be used to engrave the upper surface of the insulation substrate 61 to form the recessed slot 61A.

Figure 16:
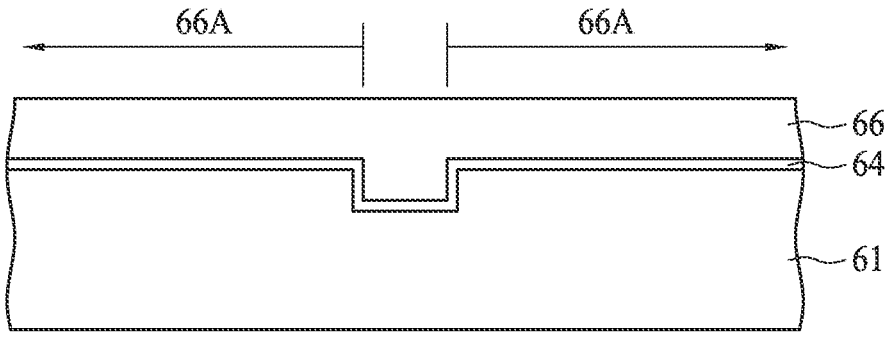
Figure 17:
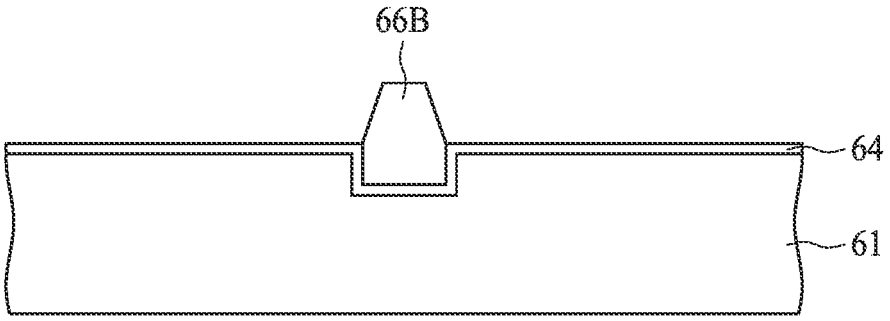

With reference to FIG. 16, a sputtering process is performed to form a seed layer 64 (for example, a titanium-tungsten alloy layer, a copper layer, a nickel-chromium alloy layer) over the insulation substrate 61, and a coating process is performed to form a photoresist layer 66 on the seed layer 64, and then an exposure process is performed on a predetermined area 66A of the photoresist layer 66. Afterwards, a developing process is performed to partially remove the predetermined area 66A to form a photoresist pattern 66B, which fills the recessed slot 61A and protrudes from the insulation substrate 61, as shown in FIG. 17. In one embodiment, the photoresist pattern 66B has a cross section with a narrow top and a wide bottom.

Figure 18:
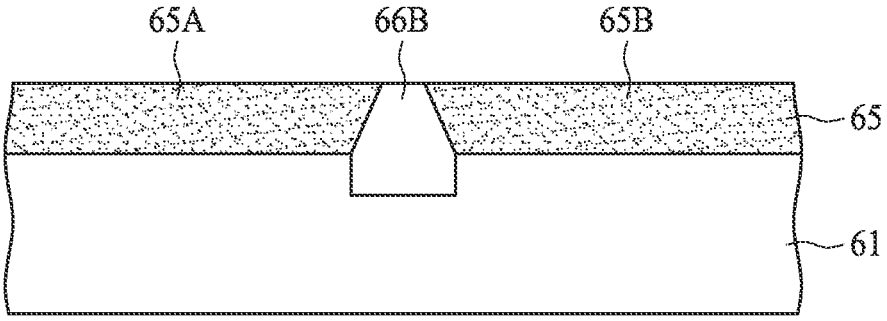
Figure 19:
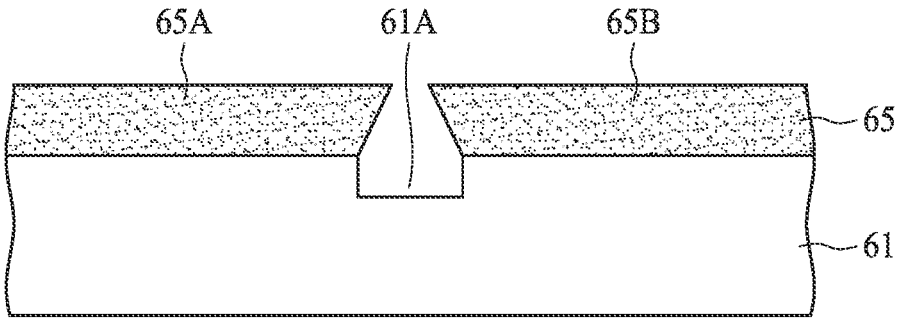

With reference to FIG. 18, an electroplating process is performed to form a conductive layer 65 over the insulation substrate 61, and the photoresist pattern 66B separates the conductive layer 65 to form a first electrode 65A and a second electrode 65B. Afterwards, the photoresist pattern 66B is removed, so the first electrode 65A and the second electrode 65B form a discharge path and the recessed slot 61A is located below the discharge path, as shown in FIG. 19. In FIG. 18 and FIG. 19, the seed layer 64 has been incorporated into the conductive layer 65 and is not shown in the figures. In one embodiment, since the photoresist pattern 66B has a cross section with a narrow top and a wide bottom, the cross section of the first electrode 65A has a first tip, the cross section of the second electrode 65B has a second tip, and the first tip and the second tip are disposed over the recessed slot 61A.

Figure 20:
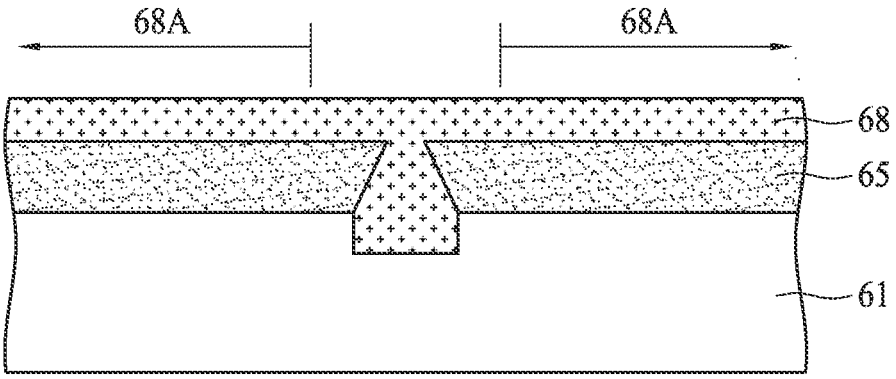
Figure 21:
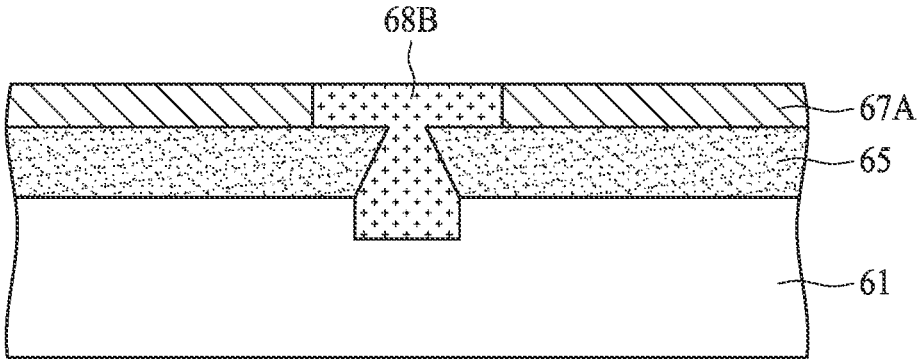

With reference to FIG. 20, a coating process is performed to form a photoresist layer 68 over the conductive layer 65, an exposure process is performed on a predetermined area 68A of the photoresist layer 68, and then a developing process is performed to partially remove the photoresist layer 68 in the predetermined area 68A to form a photoresist pattern 68B. Afterwards, the photoresist pattern 68B is used to form a lower portion 67A over the conductive layer 65, as shown in FIG. 21.

Figure 22:
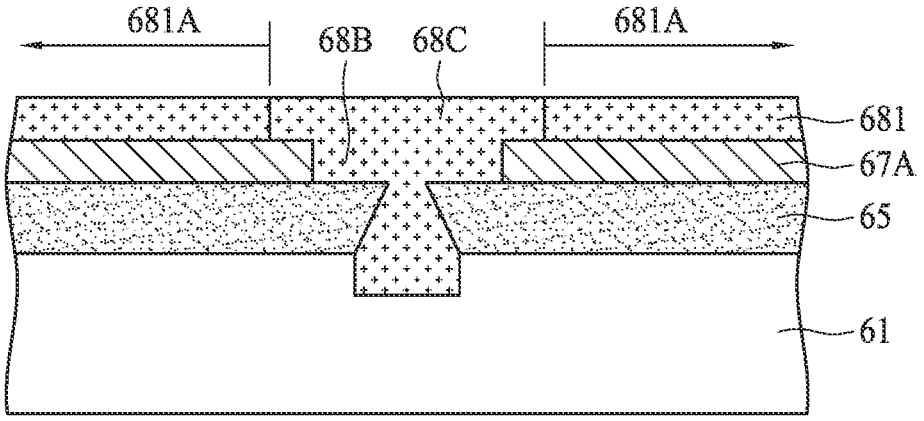
Figure 23:
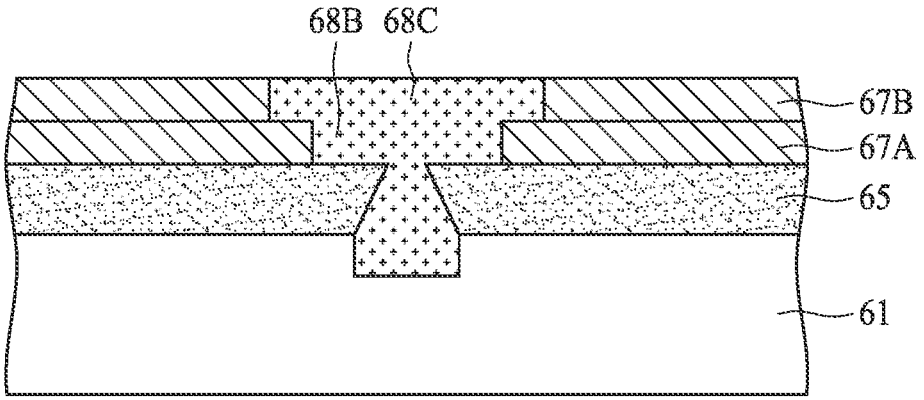

With reference to FIG. 22, a coating process is performed to form a photoresist layer 681 over the conductive layer 65 and the lower portion 67A. An exposure process is performed on a predetermined area 681A of the photoresist layer 681, and then a developing process is performed to partially remove the photoresist layer 681 in the predetermined area 681A to form a photoresist pattern 68C. The width of the photoresist pattern 68C is greater than the width of the photoresist pattern 68B. Afterwards, the photoresist pattern 68C is used to form an upper portion 67B over the lower portion 67A, as shown in FIG. 23.

Figure 24:
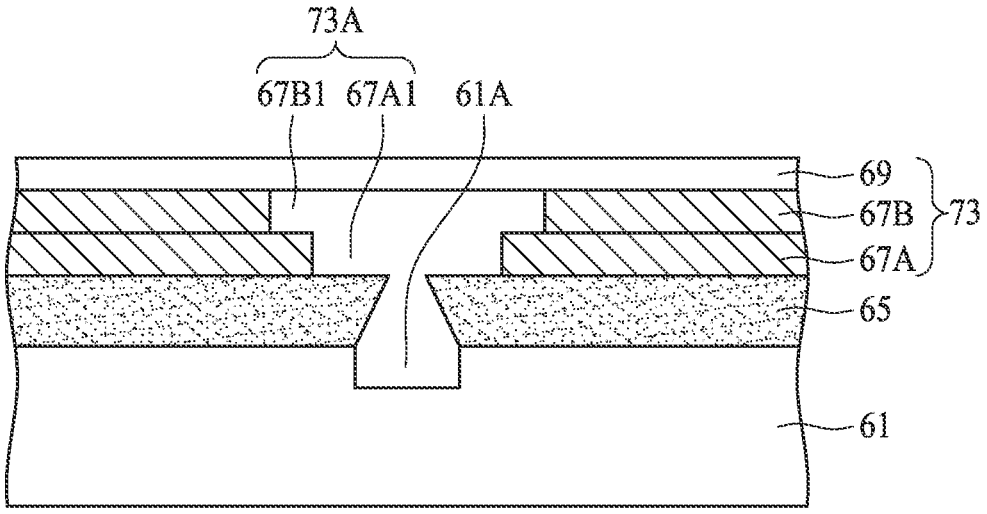

With reference to FIG. 24, the photoresist pattern 68B and the photoresist pattern 68C are removed to form a lower opening 67A1 within the lower portion 67A and an upper opening 67B1 within the upper portion 67B. The lower opening 67A1 and the upper opening 67B1 form an insulation air gap 73A, which at least partially expose the first electrode 65A and the second electrode 65B. The cross-sectional width of the insulation air gap 73A is larger than the cross-sectional width of the recessed slot 61A. Afterwards, a top cover portion 69 (for example, a polyimide dry film) is pasted on the upper portion 67B and seals the insulation air gap 73A.

Figure 25:
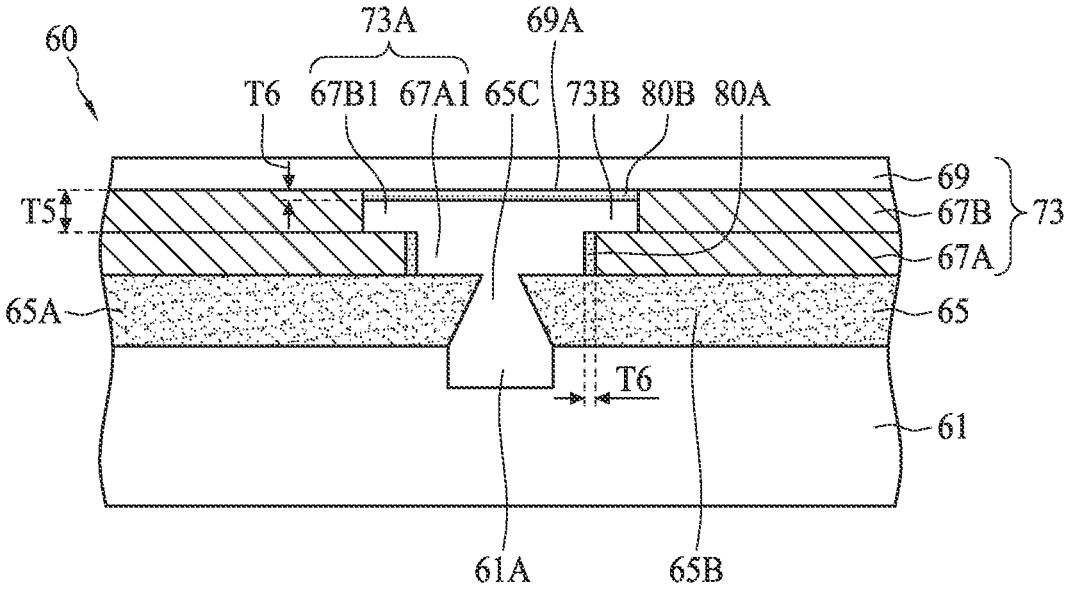

With reference to FIG. 25, in one embodiment, when a high voltage is applied to the first electrode 65A and the second electrode 65B, the first tip and the second tip discharge through the air therebetween, which acts like an arc discharge, causing the first electrode 65A and the second electrode 65B to generate electrode debris. The recessed slot 61A of the substrate 61 can accommodate the metal debris falling during the discharge, and avoid the accumulation of metal debris which causes the first electrode 65A and the second electrode 65B to form a short circuit.

In addition, the high temperature of the instantaneous point discharge of the first tip of the first electrode 65A and the second tip of the second electrode 65B will also cause the molten metal debris to spray upward and adhere to the insulation structure 73, forming a first conductive material portion 80A within the lower opening 67A1 or forming the second conductive material portion 80B on the lower surface 69A of the top cover portion 69. The innovative technique of the present disclosure is designed to have the width of the upper opening 67B1 greater than that of the lower opening 67A1. That is, the upper opening 67B1 of the insulation structure 73 is provided with a dead corner 73B. As a result, the first conductive material portion 80A and the second conductive material portion 80B formed by the molten metal debris sprayed upwards are separated by the dead corner 73A of the upper opening 67B1 of the insulation structure 73, and cannot form a continuous conductive path, so as to prevent the first electrode 65A and the second electrode 65B from forming a short circuit. In one embodiment, the thickness T6 of the second conductive material portion 80B is smaller than the thickness T5 of the upper portion 67B, so as to prevent the first conductive material portion 80A and the second conductive material portion 80B from forming a short circuit.

One embodiment of the present disclosure provides an over-voltage protection device. The over-voltage protection device includes a substrate; and a stack structure, disposed over the substrate. The stack structure includes a first insulation structure, a second insulation structure, and a conductive layer. The conductive layer is disposed on the first insulation structure, and the second insulation structure is disposed on the conductive layer. The second insulation structure has an insulation air gap, which has an upper width greater than a lower width.

Another embodiment of the present disclosure provides an over-voltage protection device, including a substrate; a conductive layer, disposed on the substrate; and an insulation structure, disposed on the conductive layer; wherein the insulation structure has an insulation air gap, which has an upper width greater than a lower width. Although the present disclosure and its advantages have been described in detail, it should be understood that various changes, substitutions and alterations may be made herein without departing from the spirit and scope of the disclosure as defined by the appended claims. For example, many of the processes discussed above may be implemented in different methodologies and replaced by other processes, or a combination thereof.

Moreover, the scope of the present application is not intended to be limited to the particular embodiments of the process, machine, manufacture, composition of matter, means, methods and steps described in the specification. As one of ordinary skill in the art will readily appreciate from the disclosure of the present disclosure, processes, machines, manufacture, compositions of matter, means, methods, or steps, presently existing or later to be developed, that perform substantially the same function or achieve substantially the same result as the corresponding embodiments described herein may be utilized according to the present disclosure. Accordingly, the appended claims are intended to include within their scope such processes, machines, manufacture, compositions of matter, means, methods, and steps.

What is claimed is:

1. An over-voltage protection device, comprising:

a substrate; and a stack structure, disposed over the substrate, wherein the stack structure comprises a first insulation structure, a second insulation structure, and a conductive layer, the conductive layer is disposed on the first insulation structure, and the second insulation structure is disposed on the conductive layer;

wherein the second insulation structure has an insulation air gap, which has an upper width greater than a lower width, and wherein the conductive layer has a conductive layer air gap, which is connected with the insulation air gap.

2. The over-voltage protection device of claim 1, wherein the second insulation structure has a thickness greater than that of the first insulation structure.

3. The over-voltage protection device of claim 1, wherein the first insulation structure has a lower air gap, which is connected with the insulation air gap.

4. The over-voltage protection device of claim 1, wherein the first insulation structure has a lower air gap, which has a width smaller than the lower width of the insulation air gap.

5. The over-voltage protection device of claim 1, wherein the conductive layer air gap has a width smaller than the lower width of the insulation air gap.

6. The over-voltage protection device of claim 1, wherein the first insulation structure has a lower air gap, and the lower air gap has a width greater than that of the conductive layer air gap.

7. The over-voltage protection device of claim 1, wherein the second insulation structure comprises:

a lower portion;

an upper portion, disposed over the lower portion; and a top cover portion, disposed over the upper portion.

8. The over-voltage protection device of claim 1, wherein the second insulation structure comprises:

a lower portion, having a lower opening;

an upper portion, disposed over the lower portion, the upper portion has an upper opening; and a top cover portion, disposed over the upper portion;

wherein the lower opening is connected with the upper opening, and an upper end of the insulation air gap is sealed by the top cover portion.

9. The over-voltage protection device of claim 1, wherein the second insulation structure comprises:

a lower portion, having a lower opening;

an upper portion, disposed over the lower portion, the upper portion has an upper opening;

a top cover portion, disposed over the upper portion;

a first conductive material portion, disposed within the lower opening; and a second conductive material portion, disposed on a lower surface of the top cover portion;

wherein the first conductive material portion and the second conductive material portion are separated from each other.

10. The over-voltage protection device of claim 1, wherein the second insulation structure comprises:

a lower portion, having a lower opening;

an upper portion, disposed over the lower portion, the upper portion has an upper opening;

a top cover portion, disposed over the upper portion;

a first conductive material portion, disposed within the lower opening; and a second conductive material portion, disposed on a lower surface of the top cover portion;

wherein the second conductive material portion has a thickness smaller than that of the upper portion.

11. An over-voltage protection device, comprising:

a substrate;

a conductive layer, disposed on the substrate; and an insulation structure, disposed on the conductive layer;

wherein the insulation structure has an insulation air gap, which has an upper width greater than a lower width, and wherein the conductive layer has a conductive layer air gap, which is connected with the insulation air gap.

12. The over-voltage protection device of claim 11, wherein the substrate has a recessed slot, and the insulation air gap has a height greater than that of the recessed slot.

13. The over-voltage protection device of claim 11, wherein the substrate has a recessed slot, which is connected with the insulation air gap.

14. The over-voltage protection device of claim 11, wherein the substrate has a recessed slot, which has a width smaller than the lower width of the insulation air gap.

15. The over-voltage protection device of claim 11, wherein the conductive layer air gap has a width smaller than the lower width of the insulation air gap.

16. The over-voltage protection device of claim 11, wherein the substrate has a recessed slot, and the recessed slot has a width smaller than that of the conductive layer air gap.

17. The over-voltage protection device of claim 11, wherein the insulation structure comprises:

a lower portion;

an upper portion, disposed over the lower portion; and a top cover portion, disposed over the upper portion.

18. The over-voltage protection device of claim 11, wherein the insulation structure comprises:

a lower portion, having a lower opening;

an upper portion, disposed over the lower portion, the upper portion has an upper opening; and a top cover portion, disposed over the upper portion;

wherein the lower opening is connected with the upper opening, and an upper end of the insulation air gap is sealed by the top cover portion.

19. The over-voltage protection device of claim 11, wherein the insulation structure comprises:

a lower portion, having a lower opening;

an upper portion, disposed over the lower portion, the upper portion has an upper opening;

a top cover portion, disposed over the upper portion;

a first conductive material portion, disposed within the lower opening; and a second conductive material portion, disposed on a lower surface of the top cover portion;

wherein the first conductive material portion and the second conductive material portion are separated from each other.

20. The over-voltage protection device of claim 11, wherein the insulation structure comprises a lower portion, having a lower opening;

an upper portion, disposed over the lower portion, the upper portion has an upper opening;

a top cover portion, disposed over the upper portion;

a first conductive material portion, disposed within the lower opening; and a second conductive material portion, disposed on a lower surface of the top cover portion;

wherein the first conductive material portion has a thickness smaller than that of the lower portion, and the second conductive material portion has a thickness smaller than that of the upper portion.

* * * * *